US008951059B2

(12) United States Patent
Chang

(10) Patent No.: US 8,951,059 B2
(45) Date of Patent: Feb. 10, 2015

(54) SAFETY RECEPTACLE FOR POWER CORD

(71) Applicant: Chi-Tsai Chang, Taichung (TW)

(72) Inventor: Chi-Tsai Chang, Taichung (TW)

( * ) Notice: Subject to any disclaimer, the term of this patent is extended or adjusted under 35 U.S.C. 154(b) by 40 days.

(21) Appl. No.: 13/792,046

(22) Filed: Mar. 9, 2013

(65) Prior Publication Data

US 2014/0227897 A1 Aug. 14, 2014

(30) Foreign Application Priority Data

Feb. 8, 2013 (TW) ..... 102202992 U

(51) Int. Cl.

| | |
|---|---|
| ***H01R 13/639*** | (2006.01) |
| ***H01R 13/633*** | (2006.01) |
| *H01R 103/00* | (2006.01) |
| *H01R 24/22* | (2011.01) |

(52) U.S. Cl.

CPC ..... *H01R 13/633* (2013.01); *H01R 13/6392* (2013.01); *H01R 2103/00* (2013.01); *H01R 24/22* (2013.01)

USPC ..... 439/346

(58) Field of Classification Search

USPC ..... 439/346

See application file for complete search history.

(56) References Cited

U.S. PATENT DOCUMENTS

| | | | | |
|---|---|---|---|---|
| 1,657,253 | A * | 1/1928 | Fortin | 439/788 |
| 3,182,281 | A * | 5/1965 | Salz, Sr. | 439/441 |
| 3,325,775 | A * | 6/1967 | Zak | 439/848 |
| 3,668,610 | A * | 6/1972 | Flanagan | 439/268 |
| 3,796,987 | A * | 3/1974 | Kinkaid et al. | 439/748 |
| 4,192,567 | A * | 3/1980 | Gomolka | 439/320 |
| 4,632,483 | A * | 12/1986 | Verin | 439/268 |
| 6,039,614 | A * | 3/2000 | Ramari | 439/843 |
| 7,083,458 | B1 * | 8/2006 | Chang | 439/346 |
| 7,104,818 | B1 * | 9/2006 | Chang | 439/140 |
| 8,152,554 | B2 * | 4/2012 | Chapel et al. | 439/346 |
| 8,668,512 | B2 * | 3/2014 | Chang | 439/304 |
| 8,714,995 | B2 * | 5/2014 | Chang | 439/345 |

* cited by examiner

*Primary Examiner* — Neil Abrams

(57) ABSTRACT

A safety receptacle for power cord includes a main body, a positioning plate, and a sheath. The positioning plate is fixed to the main body, having an elastically swayable active section. The sheath is movably sheathes the main body. The main body, the sheath, and the active section are formed with corresponding insertion holes and aperture. When the plug is inserted in the receptacle, the conductive pin of the plug is clutched by the active section so as to prohibiting slack of the plug. Additionally, the active section contacts the conductive pin by point contact, so that little dust would be produced by abrasion of the active section and the conductive pin. Without the piled dust, ignition is prevented. Safety of the receptacle is then improved.

9 Claims, 6 Drawing Sheets

SAFETY RECEPTACLE FOR POWER CORD

BACKGROUND OF THE INVENTION

1. Field of the Invention

The present invention relates to a safety receptacle.

2. Description of the Prior Art

Receptacle is provided with insertion holes and conductive plates disposed in the insertion holes. Correspondingly, plug is provided with conductive pins for inserting in the insertion holes and connecting electrically with the conductive plates. There are several causes that the connection of the receptacle and the plug may be insecure.

Firstly, the positions of the conductive plates may be imprecise or inaccurate, or the clutching force provided by the conductive plates is too weak to hold the conductive pins tightly. Therefore, the conductive pins and the plug would be loose. The plug can be dropped easily by a simple collision. To overcome the problem caused by position inaccurate, some user may bend the conductive pins to fit with the insertion holes and the conductive plates. However, once the conductive pins are bent, structure strength of the conductive pins is weakened.

Secondly, the plug is inserted in and removed from the receptacle frequently in daily use. Therefore, the conductive plates would be fatigued and loose easily. Dust would fall and pile up in the receptacle. Spark occurred in inserting the plug can ignite the dust easily. Thus, daily life of user is seriously endangered.

Accordingly, improving and maintaining tightness of the connection and engagement between plug and receptacle is important.

The present invention is, therefore, arisen to obviate or at least mitigate the above mentioned disadvantages.

SUMMARY OF THE INVENTION

The main object of the following embodiments of the present invention is to provide a safety receptacle for power cord which is provided with a positioning plate. The positioning plate is utilized for prohibiting loose of the plug inserted in the receptacle by elasticity and minimized contact area.

To achieve the above and other objects, a safety receptacle for power cord of the present invention is provided for a plug, having a main body which has a conductive plate disposed therein. The main body has an end surface which is formed with plural inner insertion holes. The main body is sheathed by a sheath. The sheath has a covering surface located at one end thereof. The covering surface is formed with plural outer insertion holes corresponding to the inner insertion holes. The sheath is able to move translationally with respect to the main body in a limited route.

It is characterized in that at least one positioning plate is disposed on the end surface of the main body. The positioning plate has a fixation section which is fixed to the main body and an active section which is exposed from the main body. The active section is formed with an aperture corresponding to the inner insertion holes and the outer insertion holes. A distance is defined between the active section and the end surface of the main body so as to define an active area at where the active section is able to sway elastically when the active section is pressed by the sheath. The active section faces the inner insertion holes. One of conductive pins of the plug is able to pierce into one of the outer insertion holes, the aperture, and one of the inner insertion holes, inserting into the conductive plate. The conductive pin and an inner periphery of the active section achieve point contact by sides thereof. Width surfaces of the conductive pin contacts no inner periphery of the active section.

Accordingly, the following advantages may be achieved:

1. The main body of the receptacle is provided with the positioning plate and sheathed by the sheath. The sheath can move and press on the active section of the positioning plate so as to determine whether the active section engages the conductive pin of the plug or not. The positioning plate is generally slant with respect to the main body, and has elasticity. Thus, the active section contacts and engages sides of the conductive pin elastically, prohibiting loose of the conductive pin or the plug.

2. The active section has a width surface facing the inner insertion holes. Thus, the active section engages the upper and lower sides of the conductive pin of the plug by points, minimized contact area, rather than linear or surface contact. The width surfaces of the conductive pin contacts no inner periphery of the active section, so that the width surfaces of the conductive pin can be kept with no abrasion. Thus, little dust would be produced by abrasion, and ignition of dust is prohibited for improving safety.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
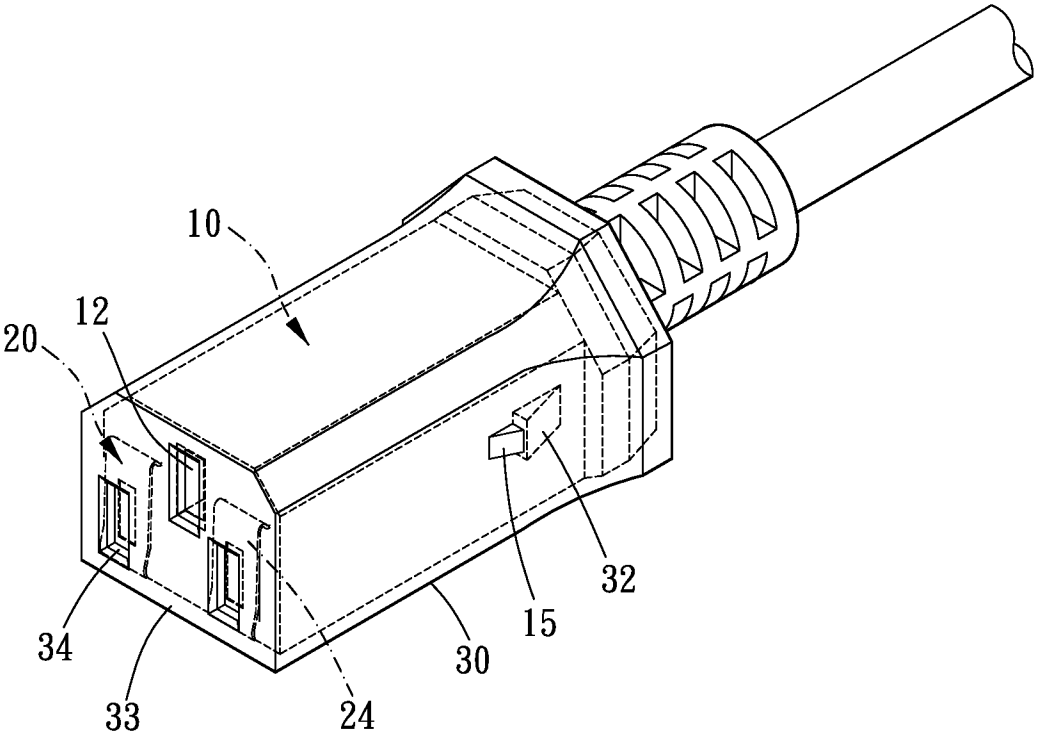
FIG. 1 is a perspective view showing a first embodiment of the present invention.

Please refer to FIG. 1 for a first embodiment of the present invention. The safety receptacle of the present embodiment includes a main body 10, a sheath 30, and at least a positioning plate 20. The positioning plate 20 is attached to the main body 10 by insertion. The main body 10 is sheathed and covered by the sheath 30.

Figures 2, 3:
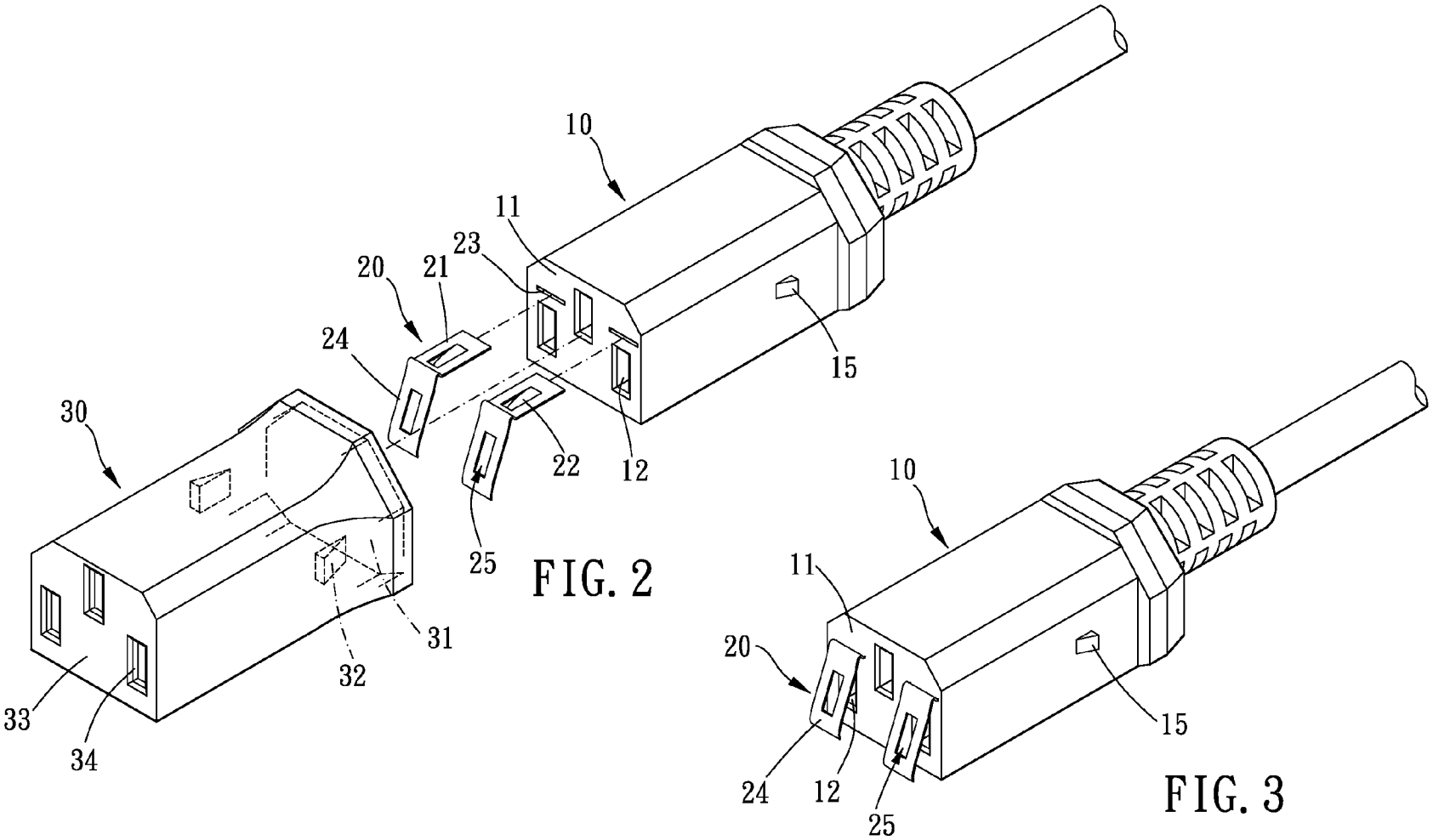
FIG. 2 is a combination drawing showing a first embodiment of the present invention.
FIG. 3 is a stereogram showing a main body and positioning plates of a first embodiment of the present invention.
Figure 4:
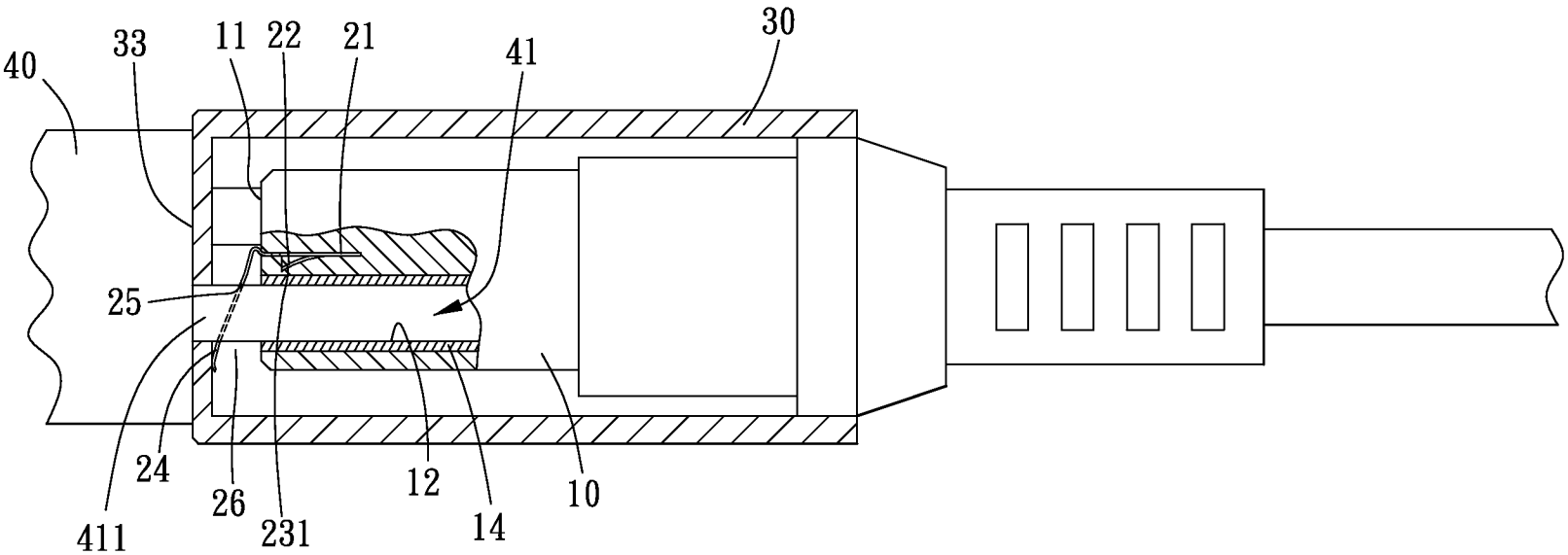
FIG. 4 is a profile showing a first embodiment of the present invention.

Please refer to FIG. 2 to FIG. 4. The main body 10 has an end surface 11 which is formed with more than two inner insertion holes 12. Conductive plates 14 are disposed in the main body 10 corresponding to quantity and position of the inner insertion holes 12. The conductive plate 14 may be U-shaped so as to clutch at and electrically contact with the conductive pins 41 of the plug 40. The main body 10 has two protrusions 15 formed symmetrically at two outer surfaces of the main body 10. The protrusions 15 are formed with slant surfaces.

The positioning plates 20 are disposed to the main body 10. The positioning plate 20 may be made of conductive material in L-shaped, so that the positioning plate has two sections. One section is fixation section 21 which is utilized for being fixed to the main body 10. The other section is active section 24 which is exposed from the main body 10. For fixing the fixation section 21, the fixation section 21 is formed with engagement piece 22, and the main body 10 is formed with fixation groove 23 and engagement groove 231. The fixation groove 23 is located above two adjacent inner insertion holes 12, formed as a linear seam. The fixation groove 23 is recessed from the end surface 11 with a predetermined depth. The engagement groove 231 is located in the fixation groove 23, as shown in FIG. 4. Therefore, the fixation section 21 is received in the fixation groove 23 and is fixed to the main body 10 by engagement of the engagement piece 22 and the engagement groove 231. The active section 24 is formed with a rectangular aperture 25, as shown in FIG. 2. An angle defined between the fixation section 21 and the active section 24 is larger than 90 degree. Thus, where the fixation section 21 is perpendicular to the end surface 11, the active section 24 is tilted away from the end surface 11. A distance is then defined between the active section 24 and the end surface 11 of the main body 10, defining an active area 26, as shown in FIG. 4, at where the active section 24 is able to sway elastically when the active section 24 is pressed. The aperture 25 is located corresponding to one of the inner insertion holes 12.

The main body 10 is sheathed by the sheath 30, as shown in FIGS. 1, 2, and 4. One end of the sheath 30 is formed with a receiving groove 31, and the other end is formed with a covering surface 33. The covering surface 33 is formed with outer insertion holes 34 which are corresponding to the inner insertion holes 12 and the active section 24 of the positioning plate 20. The outer insertion holes 34 are connected to the receiving groove 31. The sheath 30 is formed with two abutting pieces 32 located in the receiving groove 31 and on the inner side surfaces of the sheath 30. The abutting pieces 32 are formed with slant surfaces. The abutting pieces 32 contact with and pass by the protrusions 15 by the slant surfaces of the abutting pieces 32 and the protrusions 15 in fabricating the sheath 30 on the main body 10, as shown in FIG. 1. Thus, the main body 10 is able to be received in the receiving groove 31, and the sheath 30 is restricted so that the sheath 30 is able to move translationally toward the main body 10 with a limited route which is limited by abutting against of the abutting pieces 32 and the protrusions 15.

As shown if FIG. 1 and FIG. 4, the positioning plates 20 are enclosed and protected by the sheath 30. The aperture 25 is corresponding to one of the outer insertion holes 34. There is a distance between the covering surface 33 and the end surface 11 of the main body 10, containing the active area 26 therein.

Figure 5:
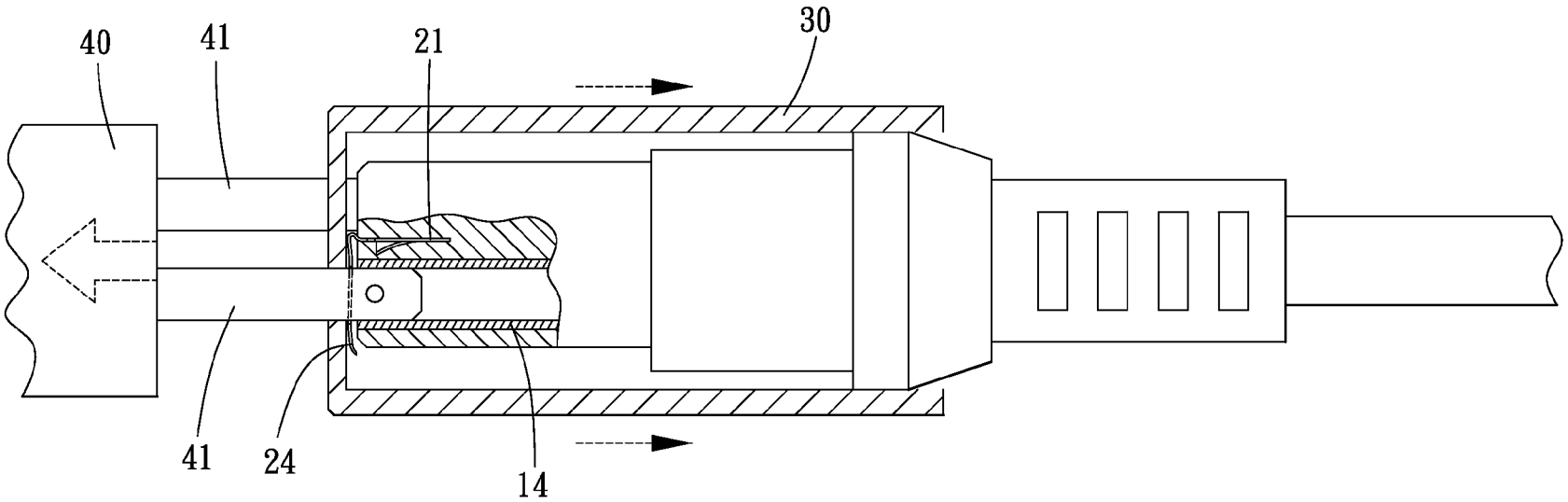
FIG. 5 is a profile showing an operational condition of a first embodiment of the present invention.

As shown in FIGS. 2, 4, and 5, when the conductive pins 41 of the plug 40 are inserted in the main body 10, the sheath 30 is retreated toward the main body 10. The active section 24 of the positioning plate 20 is pressed by the covering surface 33, and the active area 26 is temporarily eliminated. By the time, the aperture 25, the inner insertion holes 23, and the outer insertion holes 34 are lined up, and the conductive pins 41 can pierce into the aperture and the insertion holes. Thus, the conductive pins 41 can be inserted into the conductive plates 14, clutched by the conductive plates 14, and achieving electrical connection with the conductive plates 14. The sheath 30 is then released and pushed back by the recovery force of the active section 24 of the positioning plate 20. The sheath 30 moves translationally back to the initial position prior pressing on the active section 24. The active section 24 tilts away from the end surface 11 of the main body 10, and then the active area 26 and the distance between the active section 24 and the end surface 11 emerge again. For removing the plug 40 from the receptacle, pressing and retreating the sheath 30 to press the active section 24 and to eliminate the active area 26. The aperture and the insertion holes are lined up again, and the conductive pins 41 can be removed from the conductive plates 14, the inner insertion holes 12, and the main body 10.

As shown in FIG. 4, because of the space reserved in the active space, the active section 24 can be provided tilted and elastically. The aperture 25 is then tilted generally, also. Thus, the inner periphery of the aperture 25 can contact and engage sides of the conductive pin 41 inserted in. In the end, the conductive pin 41 is held and kept contact with the conductive plate 14 so as to prohibiting slack of the conductive pin and plug.

Additionally, the active section and the inner periphery of the aperture 25 contact with upper side and lower side of the conductive pin 41 in only points, rather than linear contact or surface contact. The width side surface of the conductive pin contacts no positioning plate. Abrasion of the width side surface of the conductive pin is avoided, producing little dust which may be dropped from the conductive pin by scratching. Without the metal dust, ignition can be prevented easily. In other words, by the receptacle mentioned above, the conductive pin of the plug is clutched by a method which produces little dust so as the improving safety of the receptacle.

Figure 6:
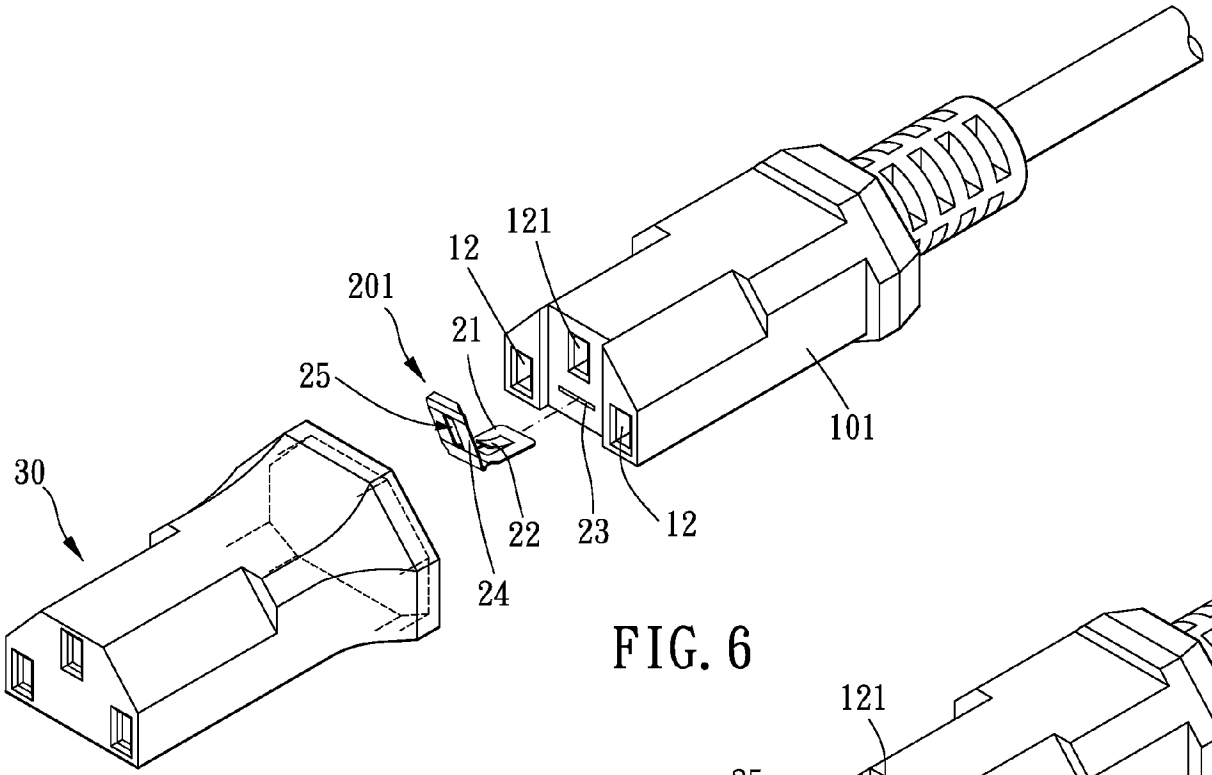
FIG. 6 is a combination drawing showing a second embodiment of the present invention.
Figure 7:
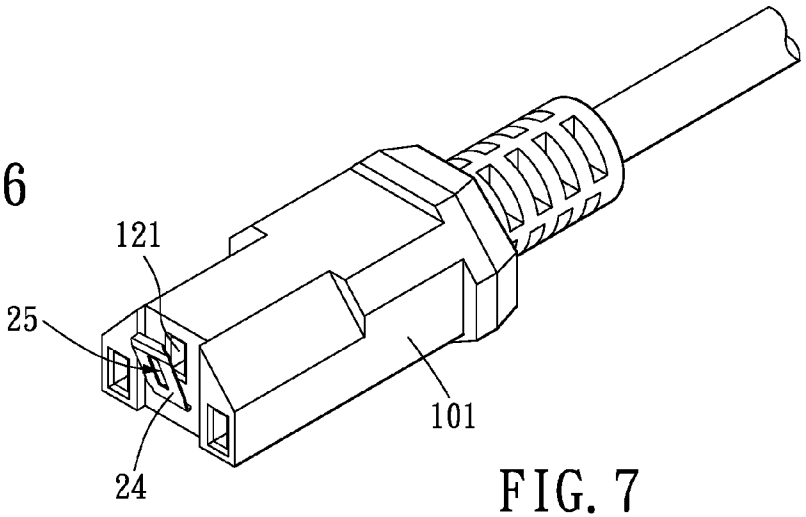
FIG. 7 is a stereogram showing a main body and positioning plates of a second embodiment of the present invention.

Please refer to FIG. 6 and FIG. 7 for a second embodiment of the present invention. The main body 101 is formed with three inner insertion holes 12, 121. Single positioning plate 201 may be disposed to the main body, corresponding to the inner insertion hole 121. Similarly, the fixation section 21 of the positioning plate 201 is inserted into the fixation groove 23 formed on the main body 101 for fixing purpose.

Figure 8:
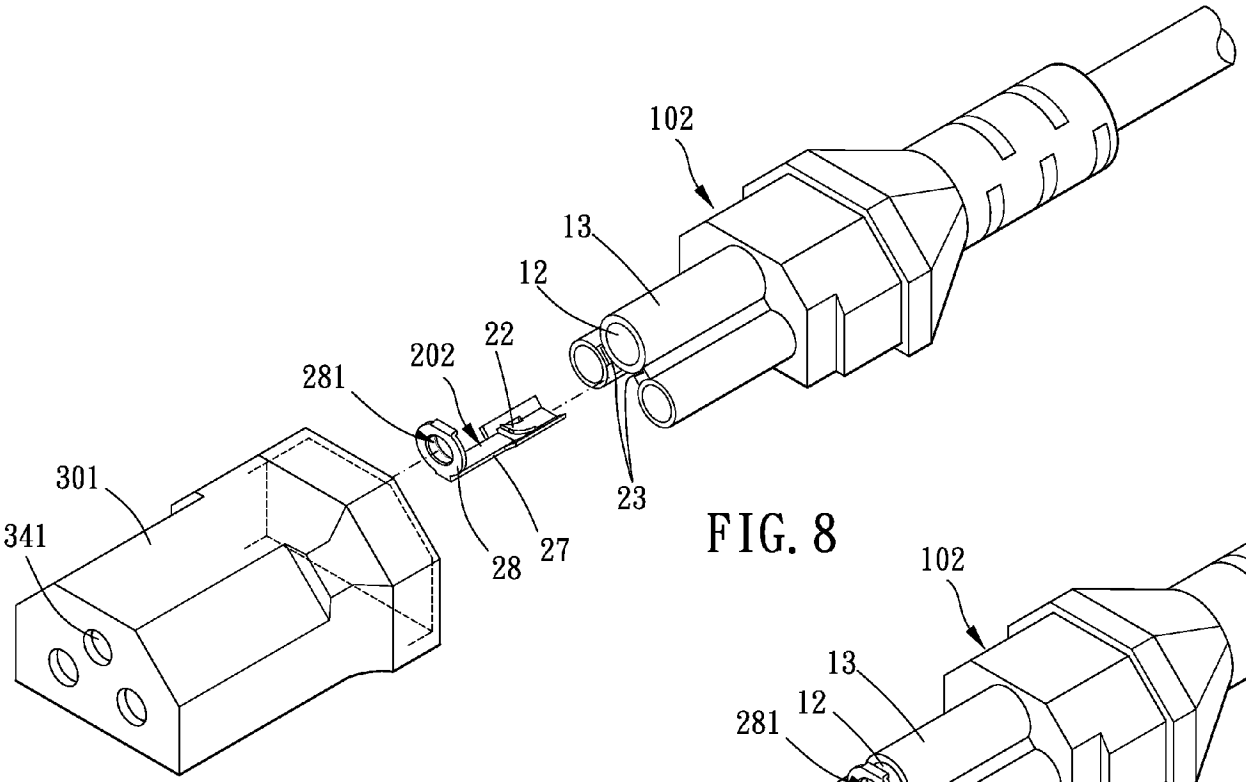
FIG. 8 is a combination drawing showing a third embodiment of the present invention.
Figure 9:
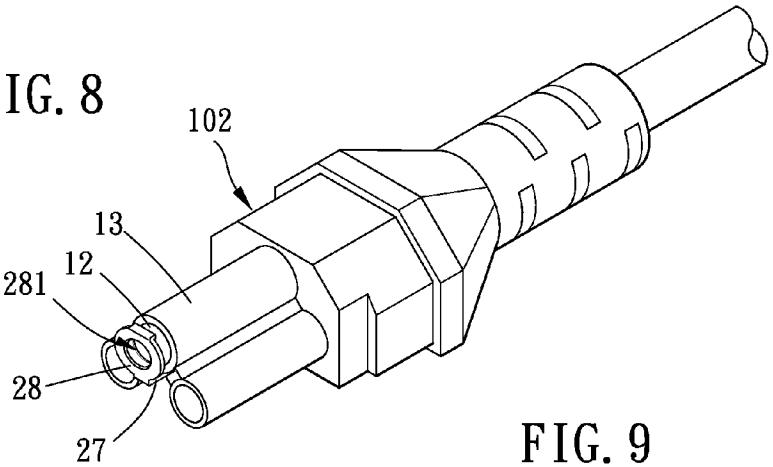
FIG. 9 is a stereogram showing a main body and positioning plates of a third embodiment of the present invention.

Please refer to FIG. 8 and FIG. 9 for a third embodiment of the present invention. The main body 102 may be formed with several columns 13, in particularly for three columns for the embodiment, each of which is formed with an inner insertion hole 12. The bottom side surface of the middle column 13 is formed with an engagement groove (not shown). The others are formed with fixation grooves 23 which are formed as seams. The positioning plate 202 is formed in L-shaped. Two sides of the fixation section 27 are formed with insertion slices. The fixation section 27 stretches beside the bottom side surface of the column 13. The insertion slices are inserted in the fixation grooves 23. By engagement of the engagement groove and the engagement piece 22, the positioning plate 202 is fixed to the main body 102. The aperture 281 of the active section 28 is corresponding to the inner insertion hole 12. A distance is defined between the active section 28 and the columns 13. The sheath 301 is formed with correspondingly circular outer insertion holes 341.

What is claimed is:

1. A safety receptacle for power cord, which is provided for a plug, the safety receptacle having a main body which has a conductive plate disposed therein, the main body having an end surface which is formed with plural inner insertion holes, the main body being sheathed by a sheath, the sheath having a covering surface located at one end thereof, the covering surface being formed with plural outer insertion holes corresponding to the inner insertion holes, the sheath being able to move translationally with respect to the main body in a limited route, characterized in that:

at least one positioning plate is disposed on the end surface of the main body, the positioning plate has a fixation section which is fixed to the main body and an active section which is exposed from the main body, the active section is formed with an aperture corresponding to the inner insertion holes and the outer insertion holes, a distance is defined between the active section and the end surface of the main body so as to define an active area at where the active section is able to sway elastically when the active section is pressed by the sheath, the active section faces toward the inner insertion holes, one of conductive pins of the plug is able to pierce into one of the outer insertion holes, the aperture, and one of the inner insertion holes, inserting into the conductive plate, the conductive pin and an inner periphery of the active section achieve point contact by sides thereof, and width surfaces of the conductive pin contacts no inner periphery of the active section;

wherein the main body is formed with plural columns, the inner insertion holes are formed respectively in the columns, and the fixation section of the positioning plate stretches beside and is fixed to a bottom side surface of the columns.

2. The safety receptacle for power cord of claim 1, wherein the positioning plate has an L-shaped appearance.

3. The safety receptacle for power cord of claim 1, wherein the fixation section of the positioning plate is formed with an engagement piece, the end surface of the main body is formed with a fixation groove which is formed as a linear seam, the main body is formed with an engagement groove which is located in the fixation groove, and the fixation section is received in the fixation groove and is fixed to the main body by engagement of the engagement piece and the engagement groove.

4. The safety receptacle for power cord of claim 1, wherein an angle defined between the fixation section and the active section is larger than 90 degree.

5. The safety receptacle for power cord of claim 1, wherein the sheath has two ends, one of which is formed with a receiving groove, the other end of the sheath is formed with the covering surface, the sheath is formed with two abutting pieces located on inner side surfaces of the sheath, the abutting pieces are formed with slant surfaces, the main body is formed with two protrusions at two outer surfaces thereof, the protrusions are formed with slant surfaces, the abutting pieces contact with and pass by the protrusions by the slant surfaces of the abutting pieces and the protrusions in fabricating the sheath on the main body, so that the main body is able to be received into the receiving groove, and the route of translational movement of the sheath is limited by abutting of the abutting pieces and the protrusions.

6. The safety receptacle for power cord of claim 1, wherein the main body is formed with three inner insertion holes, the sheath is formed with three outer insertion holes, two positioning plates are disposed on the main body, and the active sections of the positioning plates are disposed corresponding to two of the inner insertions holes.

7. The safety receptacle for power cord of claim 1, wherein the main body is formed with three inner insertion holes, the sheath is formed with three outer insertion holes, single positioning plate is disposed on the main body, and the active section of the positioning plate is disposed corresponding to one of the inner insertions holes.

8. The safety receptacle for power cord of claim 1, wherein the main body is formed with three columns, one of the columns is formed with an engagement groove at the bottom side surface thereof, the fixation section is formed with an engagement piece, and the engagement piece engages with the engagement groove when the fixation section stretches by the bottom side surface.

9. The safety receptacle for power cord of claim 8, wherein two of the columns are formed with fixation grooves, each of which is formed as a seam, the fixation section is formed with insertion slices at two sides thereof, and the insertion slices are received in the fixation grooves.

* * * * *